US009525215B2

(12) United States Patent
Kawamura et al.

(10) Patent No.: US 9,525,215 B2
(45) Date of Patent: Dec. 20, 2016

(54) CRIMP TERMINAL, METHOD OF MANUFACTURING CRIMP TERMINAL, ELECTRICAL WIRE CONNECTION STRUCTURE, AND METHOD OF MANUFACTURING ELECTRICAL WIRE CONNECTION STRUCTURE

(71) Applicants: FURUKAWA ELECTRIC CO., LTD., Tokyo (JP); FURUKAWA AUTOMOTIVE SYSTEMS INC., Inukami-gun (JP)

(72) Inventors: Yukihiro Kawamura, Inukami-gun (JP); Takashi Tonoike, Inukami-gun (JP); Takuro Yamada, Inukami-gun (JP); Masakazu Kozawa, Inukami-gun (JP); Daisuke Takahashi, Inukami-gun (JP); Masafumi Kawata, Inukami-gun (JP); Tomohiro Yamazaki, Inukami-gun (JP); Hiroaki Kobayashi, Inukami-gun (JP)

(73) Assignees: FURUKAWA ELECTRIC CO., LTD., Tokyo (JP); FURUKAWA AUTOMOTIVE SYSTEMS INC., Inukami-gun (JP)

( * ) Notice: Subject to any disclaimer, the term of this patent is extended or adjusted under 35 U.S.C. 154(b) by 0 days.

(21) Appl. No.: 14/813,696

(22) Filed: Jul. 30, 2015

(65) Prior Publication Data

US 2015/0340772 A1 Nov. 26, 2015

Related U.S. Application Data

(63) Continuation of application No. PCT/JP2014/054240, filed on Feb. 21, 2014.

(30) Foreign Application Priority Data

Feb. 23, 2013 (JP) ..... 2013-033975
Feb. 24, 2013 (JP) ..... 2013-034039
Jan. 17, 2014 (JP) ..... 2014-007261

(51) Int. Cl.
*H01R 4/18* (2006.01)
*H01R 4/70* (2006.01)
(Continued)

(52) U.S. Cl.
CPC ..... *H01R 4/18* (2013.01); *H01R 4/187* (2013.01); *H01R 4/70* (2013.01); *H01R 43/048* (2013.01); *H01R 4/62* (2013.01); *Y10T 29/4922* (2015.01)

(58) Field of Classification Search
CPC ..... H01R 4/18
(Continued)

(56) References Cited

U.S. PATENT DOCUMENTS 3,955,044 A * 5/1976 Hoffman ..... H01R 4/62 174/84 C
5,254,022 A * 10/1993 Stuart ..... H01R 4/20 439/851
(Continued)

FOREIGN PATENT DOCUMENTS

JP 2002-367714 A 12/2002
JP 2004-71437 A 3/2004
(Continued)

OTHER PUBLICATIONS

International Search Report issued May 27, 2014 in PCT/JP2014/054240 (with English language translation).
(Continued)

*Primary Examiner* — Ross Gushi
(74) *Attorney, Agent, or Firm* — Oblon, McClelland, Maier & Neustadt, L.L.P.

(57) ABSTRACT

A crimp terminal that can maintain excellent water-stop performance over a long term and is enhanced in joint
(Continued)

strength between a fitting portion and a covered electrical wire connection portion. The crimp terminal has a fitting portion at a tip thereof and an electrical wire connection portion at a rear end thereof, the electrical wire connection portion is configured in a tubular shape, a tip of the tube is crushed to be superimposed and closed, and a portion between the fitting portion and the electrical wire connection portion is formed by superimposing and bending two or more sheets of a plate material.

10 Claims, 16 Drawing Sheets

(51) Int. Cl.
*H01R 43/048* (2006.01)
*H01R 4/62* (2006.01)

(58) Field of Classification Search
USPC ..... 439/877, 741
See application file for complete search history.

(56) References Cited

U.S. PATENT DOCUMENTS 7,174,633 B2 * 2/2007 Onuma ..... H01R 4/04 29/854
7,402,089 B1 * 7/2008 Myer ..... H01R 13/11 439/877
7,494,388 B2 * 2/2009 Kakuta ..... H01R 4/185 439/877
7,828,611 B2 * 11/2010 Nakamura ..... H01R 4/185 439/877
8,177,590 B2 * 5/2012 Tanaka ..... H01R 4/185 439/877
8,210,884 B2 * 7/2012 Corman ..... H01R 4/185 439/877
8,607,449 B2 * 12/2013 Kitagawa ..... H01R 4/185 174/11 R
8,723,040 B2 * 5/2014 Sakura ..... H01R 4/185 174/68.1
8,771,015 B2 * 7/2014 Inoue ..... H01R 4/70 439/604
8,900,020 B2 * 12/2014 Aoki ..... H01R 4/183 439/851
8,974,258 B2 * 3/2015 Mitose ..... H01R 4/184 439/877
9,022,821 B2 * 5/2015 Matsushita ..... H01R 4/185 439/879
9,033,751 B2 * 5/2015 Sato ..... H01R 4/206 439/877
9,065,261 B2 * 6/2015 Kawamura ..... H01R 4/183
9,070,988 B2 * 6/2015 Sato ..... H01R 4/184
9,083,100 B2 * 7/2015 Uno ..... H01R 4/70
9,118,123 B2 * 8/2015 Kawamura ..... H01R 4/187
9,136,613 B2 * 9/2015 Matsushita ..... H01R 4/185
9,236,667 B2 * 1/2016 Shimizu ..... H01R 4/70
9,240,635 B2 * 1/2016 Kawamura ..... H01R 4/206
9,246,292 B2 * 1/2016 Tachibana ..... H01R 43/048
9,263,808 B2 * 2/2016 Kawamura ..... H01R 43/0482
9,281,574 B2 * 3/2016 Kawamura ..... H01R 4/183
9,287,634 B2 * 3/2016 Kawamura ..... H01R 4/10
9,293,838 B2 * 3/2016 Sakaguchi ..... H01R 4/62
2004/0168315 A1 * 9/2004 Onuma ..... H01R 4/04 29/854
2004/0242068 A1 12/2004 Fukuda et al.
2007/0184715 A1 * 8/2007 Onuma ..... H01R 4/04 439/587
2010/0144189 A1 * 6/2010 Watanabe ..... H01R 4/62 439/421
2011/0177727 A1 * 7/2011 Zhao ..... H01R 4/023 439/874
2013/0025935 A1 * 1/2013 Takayama ..... H01R 4/184 174/75 R
2013/0045644 A1 * 2/2013 Aoki ..... H01R 4/183 439/878
2013/0095708 A1 * 4/2013 Mitose ..... H01R 4/184 439/878
2014/0106628 A1 * 4/2014 Sato ..... H01R 4/206 439/877
2014/0151083 A1 * 6/2014 Ohnuma ..... H01R 4/184 174/93
2014/0154915 A1 * 6/2014 Ohnuma ..... H01R 4/184 439/587
2014/0194002 A1 * 7/2014 Sato ..... H01R 13/5216 439/589
2014/0242852 A1 * 8/2014 Matsui ..... H01R 13/521 439/730
2014/0273667 A1 * 9/2014 Tachibana ..... H01R 43/048 439/877
2014/0335745 A1 * 11/2014 Kawamura ..... H01R 4/10 439/878
2014/0349501 A1 * 11/2014 Aizawa ..... H01R 4/72 439/190
2014/0374155 A1 * 12/2014 Tachibana ..... H01R 4/62 174/84 C
2014/0378009 A1 * 12/2014 Yamada ..... H01R 4/187 439/865
2015/0011117 A1 * 1/2015 Ohnuma ..... H01R 4/185 439/520
2015/0021090 A1 * 1/2015 Mano ..... H01R 4/185 174/72 A
2015/0072573 A1 * 3/2015 Kawamura ..... H01R 4/203 439/867
2015/0126078 A1 * 5/2015 Kawamura ..... H01R 43/005 439/874
2015/0126079 A1 * 5/2015 Kawamura ..... H01R 4/206 439/877
2015/0140873 A1 * 5/2015 Ito ..... H01R 4/62 439/877
2015/0140874 A1 * 5/2015 Sakaguchi ..... H01R 4/62 439/879
2015/0155673 A1 * 6/2015 Kawamura ..... H01R 43/02 29/860
2015/0229039 A1 * 8/2015 Kawamura ..... H01R 4/20 174/72 A
2015/0287496 A1 * 10/2015 Sato ..... H01R 4/62 174/74 R
2015/0333416 A1 * 11/2015 Kihara ..... H01R 4/20 439/877
2015/0340772 A1 * 11/2015 Kawamura ..... H01R 4/187 439/877
2015/0357723 A1 * 12/2015 Tachibana ..... C25D 7/00 439/878
2015/0357724 A1 * 12/2015 Okuno ..... C25D 7/00 439/877
2015/0357725 A1 * 12/2015 Matsuo ..... C22C 9/00 439/877
2015/0357782 A1 * 12/2015 Kawamura ..... H01R 43/052 29/882
2015/0364833 A1 * 12/2015 Tonoike ..... H01R 4/183 439/879
2015/0364834 A1 * 12/2015 Kawamura ..... H01R 43/05 439/879
2015/0364835 A1 * 12/2015 Tonoike ..... H01R 43/0488 439/879
2015/0364836 A1 * 12/2015 Yagi ..... B23K 26/32 439/877
2015/0364837 A1 * 12/2015 Yagi ..... H01R 4/187 439/879
2016/0006135 A1 * 1/2016 Terashima ..... H01R 4/183 174/72 A
2016/0099507 A1 * 4/2016 Tachibana ..... H01R 43/048 439/877

FOREIGN PATENT DOCUMENTS

JP 2004-200094 A 7/2004
JP 2005-339850 A 12/2005
JP 2011-233328 A 11/2011

(56) References Cited

FOREIGN PATENT DOCUMENTS

| | | | |
|---|---|---|---|
| JP | 2012-3856 | A | 1/2012 |
| JP | 2013-175413 | A | 9/2013 |
| JP | 2014-63610 | A | 4/2014 |
| WO | WO 2014/014105 | A1 | 1/2014 |

OTHER PUBLICATIONS

International Preliminary Report on Patentability and Written Opinion issued Sep. 3, 2015 in PCT/JP2014/054240.
Office Action issued May 20, 2014 in Japanese Patent Application No. 2014-512205 (with English language translation).
Office Action issued Jun. 24, 2014 in Japanese Patent Application No. 2014-512205 (with English language translation).
Decision to Grant a Patent issued Jul. 22, 2014 in Japanese Patent Application No. 2014-512205 (with English language translation).
Office Action issued Sep. 9, 2016 in European Patent Application No. 14 753 982.9.

* cited by examiner

CRIMP TERMINAL, METHOD OF MANUFACTURING CRIMP TERMINAL, ELECTRICAL WIRE CONNECTION STRUCTURE, AND METHOD OF MANUFACTURING ELECTRICAL WIRE CONNECTION STRUCTURE

BACKGROUND OF THE INVENTION

1. Technical Field

The present invention relates to a crimp terminal to be mounted to a connector or the like that serves to connect a wire harness for a vehicle, for example, a method of manufacturing the crimp terminal, an electrical wire connection structure and a method of manufacturing the electrical wire connection structure.

2. Related Art

A crimp terminal has a crimp portion to which a conductor of a covered electrical wire is electrically connected. After the covered electrical wire is inserted into the crimp portion, the crimp portion is swaged and crimped to the conductor to thereby connect the covered electrical wire. Such a crimp terminal is used for a wire harness that connects electrical components of a vehicle, for example. The wire harness comprises a bundle of plural covered electrical wires, and a connector is connected to the tip of the wire harness. As disclosed in JP-A-2002-367714, a crimp terminal is connected to the tip portion of a covered electrical wire in a connector. The crimp terminal is connected to a terminal of another electrical equipment or the like.

Increase in number of electrical equipment installed in a vehicle causes increase in number of covered electrical wires. In addition, it is necessary to enhance fuel consumption of vehicles. Therefore, in order to reduce the weight of a wire harness, attention has been paid to change of a core wire of a covered electrical wire from copper to aluminum or aluminum alloy. The weight of the covered electrical wires may occupy 60% or more of the whole weight of the wire harness, and it is possible to greatly reduce the weight by changing the material of the core wire to aluminum-based material.

However, when the copper conductor is replaced by the aluminum conductor, the contact between the crimp portion of the crimp terminal and the conductor is the contact between dissimilar metals because the crimp terminal is formed of copper. That is, the crimp portion is easily corroded when coming into contact with water or moisture. This is called as contact corrosion between dissimilar metals (electrical corrosion). Therefore, in order to enable material change to aluminum with prevention of electrical corrosion, there has been developed a technique of shielding the contact interface between the aluminum conductor and the crimp terminal from the outside with resin material and performing cut-off (water-stopping) performance as disclosed in JP-A-2012-3856 or the like, for example. According to a corrosion preventing structure disclosed in JP-A-2012-3856, after a covered electrical wire is connected to a crimp terminal, a mold portion formed of resin is formed at the connection portion between the crimp terminal and the covered electrical wire.

When a wire harness is used in a vehicle, the usage environment of the wire harness is harsh, so that moisture or dust adheres to the wire harness or the temperature of the wire harness increases. Furthermore, the core wire and the crimp terminal are formed of aluminum-based material and copper-based material respectively, and thus they are connected to each other as the connection between dissimilar metals. Therefore, when moisture or the like adheres to the connection portion between the core wire and the crimp terminal, electrical corrosion such as contact corrosion between dissimilar metals or the like is liable to occur. The electrical corrosion causes contact failure between the core wire and the crimp terminal. The electrical corrosion must be avoided to secure electrical connection of electrical equipment.

Here, it is considered that the core wire is sealed with resin as disclosed in JP-A-2011-233328.

SUMMARY

However, according to the corrosion preventing structure disclosed in Patent Document 2, the connection portion between the crimp terminal formed of metal and the covered electrical wire formed of resin is molded with resin material. Therefore, there is a risk that the molded resin material deteriorates during use and the cut-off (water-stopping) performance degrades.

The crimp terminal disclosed in Patent Document 2 has a fitting portion functioning as a connector as well as the covered electrical wire connection portion to be connected to the covered electrical wire, and the conventional structure has a problem in joint strength between the fitting portion and the covered electrical wire connection portion.

When the core wire is sealed with resin as disclosed in Patent Document 3, materials increase and the production efficiency decreases. As described above, the usage environment of the wire harness is harsh, and when the temperature greatly varies, there is a risk that cracks occur in the sealed portion or gaps occur among respective members due to the difference in expansion coefficient among the respective members or the like. Furthermore, there is a risk that moisture reaches the connection portion between the core wire and the crimp terminal and thus electrical corrosion occurs. When the strength of the crimp terminal is low, the crimp terminal is easily deformed. Cracks or the like occur in the sealed portion, and electrical corrosion is liable to occur.

In order to solve the above problem, the present invention has an object to provide a crimp terminal that can keep excellent cut-off performance over a long term under the state that the crimp terminal is crimped to a covered electrical wire, and enhance the joint strength between a fitting portion and a covered electrical wire connection portion, a method of manufacturing the crimp terminal, an electrical wire connection structure and a method of manufacturing the electrical wire connection structure.

Furthermore, the present invention has an object to provide a crimp terminal that prevents electrical corrosion and enhances strength, and a method of manufacturing the crimp terminal.

In order to attain the above object, according to a first aspect of the present invention, a crimp terminal comprises a fitting portion at a tip thereof and an electrical wire connection portion at a rear end thereof, wherein the electrical wire connection portion is configured in a tubular shape, a tip of the tube is crushed to be superimposed and closed, thereby forming a superimposed and closed portion, and a portion between the fitting portion and the electrical wire connection portion and the superimposed and closed portion of superimposed two or more sheets of a plate material are bent to form the crimp terminal.

In this construction, the electrical wire connection portion is tubular, and the tip of the tube is crushed to be superimposed and closed, so that excellent water-stop performance can be maintained for a long term. The electrical wire connection portion is configured annularly in section to have an internal space for allowing insertion of at least a tip portion of a conductor therein, for example, and confronting parts of the inner surface of the tube tip having the annular cross-section are brought into close contact with each other to construct a sealing portion, whereby water-stop performance can be surely maintained.

The portion between the fitting portion and the electrical wire connection portion is formed by superimposing and bending two or more sheets of the plate material. Therefore, the section modulus of the portion is enhanced more greatly than those of the other portions, and the strength of the crimp terminal can be secured. As a result, moisture can be prevented from infiltrating from the tip side of the electrical wire connection portion, and the sealing portion having enough strength to endure neck breaking, etc. can be formed. Accordingly, the water-stop performance can be maintained over a long term under the crimp state to the covered electrical wire.

As an embodiment of the present invention, the crimp terminal may be formed by approaching the fitting portion and the electrical wire connection portion and bending the superimposed and closed portion.

A bending and erecting shape may be uniform over a site from the fitting portion to the superimposed and closed portion.

The portion between the fitting portion and the electrical wire connection portion may be configured to be bent in U-shape, V-shape or concave shape.

The rate of height H to width W of a sealing portion obtained by superimposing and bending the two or more sheets of the plate material is within 65%.

In general, when the portion between the fitting portion and the electrical wire connection portion is set as a transition portion, difference in cross-sectional shape among the fitting portion, the transition portion and the electrical wire connection portion causes stress to be liable to concentrate on an inflection point of the shape under application of external force. Deformation and breaking easily occur due to this stress concentration.

In this construction, the bending and erecting shape is made uniform over the site from the fitting portion to the superimposed and closed portion, or formed in U-shape, V-shape or concave shape, thereby nullifying the difference in cross-sectional shape among the respective portions. Accordingly, the inflection point can be eliminated, the stress concentration under application of external force can be prevented, and deformation and breaking can be suppressed. The cross-sectional shapes of the respective portions are desired to be identical or close shapes such as similar shapes or the like.

As an embodiment of the presents invention, the electrical wire conductor may be formed of aluminum-based material and at least the electrical wire connection portion may be formed of copper-based material. In this construction, the weight can be reduced as compared with a covered electrical wire having a conductor formed of a copper wire, and so-called electrical corrosion can be prevented. Specifically, when the copper-based material which has been conventionally used for the conductor of the covered electrical wire is replaced by aluminum-based material such as aluminum, aluminum alloy or the like and the conductor formed of aluminum-based material is crimped to the crimp terminal, there occurs a problem caused by a phenomenon that the aluminum-based material as base material is corroded due to the contact between the aluminum-based material and noble metal such as tin plating, gold plating, copper alloy or the like, that is, an electrical corrosion problem occurs. The electrical corrosion is a phenomenon that adherence of moisture to a site at which noble metal and base metal are brought into contact with each other generates corrosion current, so that the base metal corrodes, solves, evanishes or the like. The conductor of aluminum-based material which is crimped to the crimp terminal corrodes, solves and evanishes due to this phenomenon, and finally the electrical resistance increases. As a result, sufficient electrically conductive function cannot be performed.

According to this construction, the water-stop performance can be surely maintained, so that the so-called electrical corrosion can be prevented while the weight can be reduced as compared with the covered electrical wire having the conductor formed of copper-based material. As a result, the connection state which can secure stable conductivity can be constructed irrespective of the types of metals constituting the crimp terminal and the conductor of the covered electrical wire.

According to a second aspect of the present invention, a method of manufacturing a crimp terminal having a fitting portion at a tip thereof and an electrical wire connection portion at a rear end thereof, the electrical wire connection portion being configured in a tubular shape, comprises: forming a superimposed and closed portion by crushing a tip of the tube so that the tip of the tube is superimposed and closed; and forming the fitting portion by integrally bending a portion between the fitting portion and the electrical wire connection portion and the superimposed and closed portion of superimposed two or more sheets of a plate material.

In this case, a portion between the fitting portion and the superimposed and closed portion may be bent while a bending and erecting shape is uniform.

A portion between the fitting portion and the electrical wire connection portion is formed to be bent in U-shape, V-shape or concave shape.

Some patterns may be considered as the method of manufacturing the crimp terminal in which the fitting portion and the electrical wire connection portion are connected to each other through the transition portion.

A procedure of first completing the fitting portion, and then completing the electrical wire connection portion.

A procedure of first completing the electrical wire connection portion and then completing the fitting portion.

In each procedure, the first completed portion is dragged and easily deformed in a processing step for a portion which is subsequently processed.

As a countermeasure to this problem, the transition portion may be lengthened, or the transition portion may be formed of one sheet of a flat plate, whereby the effect of the subsequently executed processing is absorbed so as not to be transferred to the previously processed portion.

However, when the transition portion is lengthened or the transition portion is formed of one sheet of the flat plate, the strength is insufficient. Therefore, in order to increase the strength, it may be considered that the transition portion is bent in a concave shape to increase the section modulus. At this time, when the transition portion is bent in a concave shape after the fitting portion and the electrical wire connection portion are completed, the bending work has an influence on both the fitting portion and the electrical wire connection portion.

According to this construction, the tip of the tube is crushed to be superimposed and closed, and the fitting portion is formed to be bent integrally with the superimposed and closed portion while containing the superimposed and closed portion. Therefore, the bending work of the site corresponding to the so-called superimposed and closed portion is completed simultaneously with completion of the fitting portion.

Accordingly, unlike the above procedures to be compared, the bending work of the so-called superimposed and closed portion has no influence on the fitting portion and the electrical wire connection portion.

Furthermore, according to this construction, the bending and erecting shape is uniform over the site from the fitting portion to the superimposed and closed portion, or is U-shaped, V-shaped or concave-shaped, whereby the cross-sectional shape over the site from the fitting portion to the superimposed and closed portion is uniform. Accordingly, the inflection point is eliminated, so that stress concentration under application of external force can be prevented, and deformation and breaking can be suppressed. The cross-sectional shapes may be identical or close shapes such as similar shapes or the like among the respective portions.

According to a third aspect of the present invention, an electrical wire connection structure comprises: a crimp terminal that comprises a fitting portion at a tip thereof and an electrical wire connection portion at a rear end thereof, the electrical wire connection portion being configured in a tubular shape, and is formed by crushing a tip of the tube so that the tip of the tube is superimposed and closed, thereby forming a superimposed and closed portion, and bending a portion between the fitting portion and the electrical wire connection portion and the superimposed and closed portion of superimposed two or more sheets of a plate material; and an electrical wire that is crimp-connected to the electrical wire connection portion of the crimp terminal.

Furthermore, according to a fourth aspect of the present invention, a method of manufacturing an electrical wire connection structure in which an electrical wire is crimp-connected to an electrical wire connection portion of a crimp terminal comprising a fitting portion at a tip thereof and the electrical wire connection portion at a rear end thereof, the electrical wire connection portion being configured in a tubular shape, comprises: crushing a tip of the tube so that the tip is superimposed and closed, thereby forming a superimposed and closed portion; and forming the fitting portion by bending a portion between the fitting portion and the electrical wire connection portion and the superimposed and closed portion of superimposed two or more sheets of a plate material integrally with each other.

According to the present invention, the electrical wire connection structure which can secure stable electrical conductivity can be configured.

Furthermore, a wire harness may be constructed by bundling a plurality of electrical connection structures described above and connecting the respective crimp-terminals to a multi-core connector.

The crimp terminal according to the present invention has the cylindrical crimp portion, the transition portion connected to one end portion of the crimp portion, and a convex portion which is provided to the crimp portion, the transition portion or a site from the transition portion to the crimp portion. The transition portion connected to the crimp portion is sealed so that the plate material is superimposed. An intermediate portion in the longitudinal direction of the superimposed portion of the plate material is welded in the width direction of the terminal, whereby one end portion of the crimp portion is sealed, and the convex portion is formed at a site from this portion to a part of the crimp portion.

The transition portion is located at a position between the upper and lower portions of the crimp portion in the height direction of the crimp portion. The position of the transition portion is not limited to this position. The transition portion serves as a narrowed portion with respect to the crimp portion. The crimp terminal may be configured so that the transition portion is narrowed with respect to the crimp portion and has no convex portion.

A covered electrical wire is inserted and crimped in the crimp portion, a core wire of the covered electrical wire is formed of aluminum-based material, and the crimp terminal is formed of copper-based material. The crimp terminal and the core wire of the covered electrical wire are connected with dissimilar metals.

A method of manufacturing a crimp terminal comprises the steps of: folding a metal strip having a predetermined shape to form a cylindrical crimp portion and a transition portion connected to the crimp portion; inserting a tip portion of a covered electrical wire in the crimp portion; and crimping the crimp portion and the covered electrical wire by a die, wherein the transition portion is located between upper and lower portions of the crimp portion. A convex portion is formed at the crimp portion, the transition portion or a site from the crimp portion to the transition portion in the crimping step.

The method further comprises a step of welding the crimp portion and the transition portion.

The transition portion may be configured to be narrowed with respect to the crimp portion and have no convex portion.

According to the present invention, under the crimp state to the covered electrical wire, excellent water-stop performance can be maintained for a long term. In addition, the joint strength between the fitting portion and the covered electrical wire connection portion in the crimp terminal can be enhanced.

Furthermore, according to the present invention, the crimp portion is sealed and crimped to the covered electrical wire, and no moisture enters the connection portion to the covered electrical wire, so that no electrical corrosion occurs. The strength of the crimp terminal is increased by providing the convex portion, so that breaking and deformation of the crimp terminal can be prevented. In the manufacturing process of the crimp terminal, no complicated device is used to manufacture the convex portion, and the manufacturing process is not complicated.

BRIEF DESCRIPTION OF THE DRAWINGS

FIGS. 11A to 11C are diagrams showing that the metal strip is bent and welded, wherein FIG. 11A is a longitudinally-sectional view of the metal strip, FIG. 11B is a cross-sectional view taken along A-A line of FIG. 11A, and FIG. 11C is a cross-sectional view taken along B-B line of FIG. 11A;

DETAILED DESCRIPTION OF THE INVENTION

An embodiment according to the present invention will be described hereunder with reference to the drawings.

FIGS. 1A to 1F show a female type crimp terminal 10. The female type crimp terminal 10 has a box portion (fitting portion) 20 for allowing an insertion tab of a male type connector (not shown) to be inserted from the front side corresponding to the tip side in a longitudinal direction X of the female type crimp terminal 10 to the back side of the female type crimp terminal, and a crimp portion (electrical wire connection portion) 30 which is configured integrally with the box portion 20 and located at the back side of the box portion 20 through a transition portion 20*a* having a predetermined length. For convenience sake, the transition portion 20*a* is referred to in this specification. However, in this embodiment, the transition portion 20*a* is extremely short, and it seems as if it is not existent. As described later, the dimension of the transition portion 20*a* is set to the requisite minimum dimension (for example, 0.6 mm) for punching a plate material.

The female type crimp terminal described above is formed of a copper alloy strip (not shown) of brass or the like whose surface is tinned (subjected to Sn plating), and it is a closed barrel type terminal comprising a box portion 20 which has a hollow quadratic prism shape when viewed from the front side in the longitudinal direction X, and a crimp portion 30 which has an annular cross-section when viewed from the back side. a crimp portion 30 of a male type crimp terminal (not shown) having an insertion tab to be inserted into the box portion 20 may be configured to have the same construction.

Figure 1D:
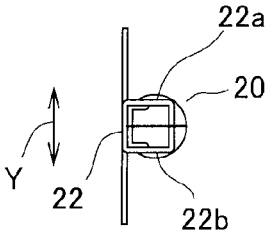
FIGS. 1A to 1F are diagrams showing a crimp terminal according to an embodiment.
Figure 1A:
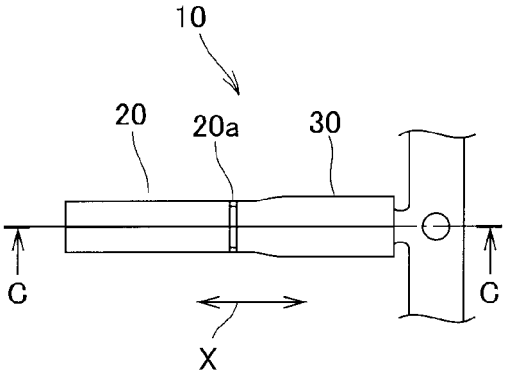
Figure 1F:
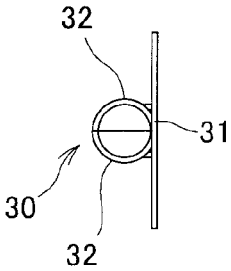
Figure 1E:
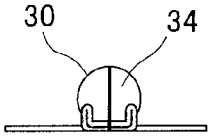
Figure 1B:
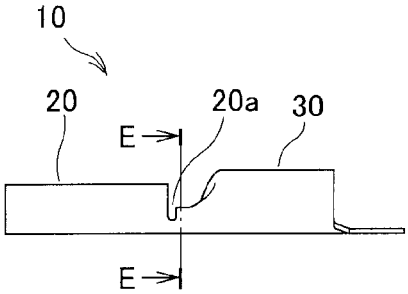
Figure 1C:
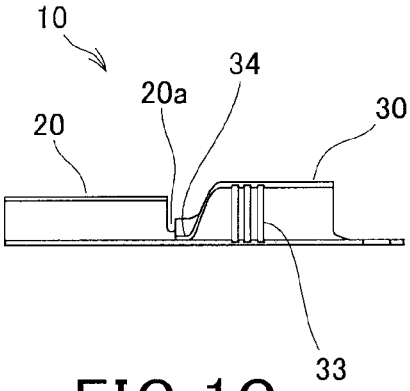
Figure 2A:
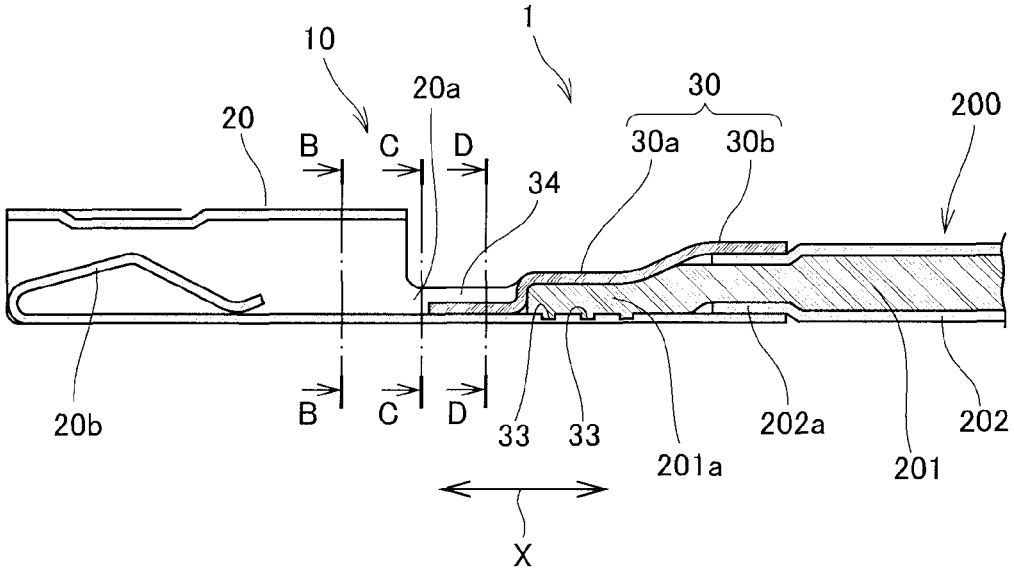
FIGS. 2A to 2D are cross-sectional views showing an electrical wire connection structure according to the embodiment.

The box portion 20 has an elastic contact piece 20*b* which is bent backwards in the longitudinal direction X and comes into contact with the insertion tab (not shown) of the inserted male type connector (see FIG. 2A, not shown in FIG. 1).

Side surface portions 23*a*, 23*b* continuous with both the side portions of the bottom surface portion 22 in the width direction Y perpendicular to the longitudinal direction X are folded so that the box portion 20 is substantially rectangular when viewed from the front side in the longitudinal direction X (see FIG. 1D). The crimp portion 30 before crimping is provided continuously with both the ends of the crimp bottom surface 31 in the width direction Y perpendicular to the longitudinal direction X, and is constructed by an annular barrel piece 32 which is substantially annular when viewed from the back side in the longitudinal direction X (see FIG. 1F).

FIG. 2A is a longitudinally-sectional view showing an electrical wire connection structure 1 in which a covered electrical wire 200 is crimp-connected to a crimp portion 30 of a female type crimp terminal 10. The crimp portion 30 of the female type crimp terminal 30 has an annular cross-section (see FIG. 1F) when viewed from the back side, and the covered electrical wire 200 is inserted from the back side.

That is, a conductor tip portion 201*a* of an aluminum core wire 201 exposed from a cover tip 202*a* of an insulating cover 202 of the covered electrical wire 200 is crimp-connected to the crimp portion 30 of the female type crimp terminal 10, thereby constructing a crimp-connection structure 1.

The covered electrical wire 200 to be crimp-connected to the female type crimp terminal 10 is constructed by covering the aluminum core wire 201 comprising a bundle of aluminum element wires with the insulating cover 202 formed of insulating resin. Specifically, the aluminum core wire 201 is constructed by twisting aluminum alloy wires so that the area of the cross-section thereof is equal to 0.75 $mm^2$, for example. The crimp portion 30 has an electrical wire crimping portion 30*a* for crimping the conductor tip portion 201*a* of the aluminum core wire 201, and a cover crimping portion 30*b* for crimping the insulating cover 202, and the electrical wire crimping portion 30*a* and the cover crimping portion 30*b* are configured integrally with each other. The circumference and shape of the inner periphery of the crimp portion 30 are set to correspond to the outer diameter of the insulating cover 202. Three serrations as grooves in the width direction Y into which the aluminum core wire 201 bites under the state that the aluminum core wire 201 is crimped are formed on the inner surface of the electrical wire crimp portion 30*a* so as to be spaced from one another at a predetermined interval in the longitudinal direction X (see FIG. 10). The serration 33 is formed like a groove which is continuous from the crimp bottom surface 31 to the barrel piece 32.

As shown in FIG. 2, a sealing portion 34 is formed at the tip portion of the crimp portion 30 so that the inner surface of the crimp portion 30 is brought into close contact with itself.

Next, a manufacturing process of the female crimp terminal 10 will be described with reference to FIGS. 3A to 3E.

Figures 3A, 3B, 3C, 3D, 3E:
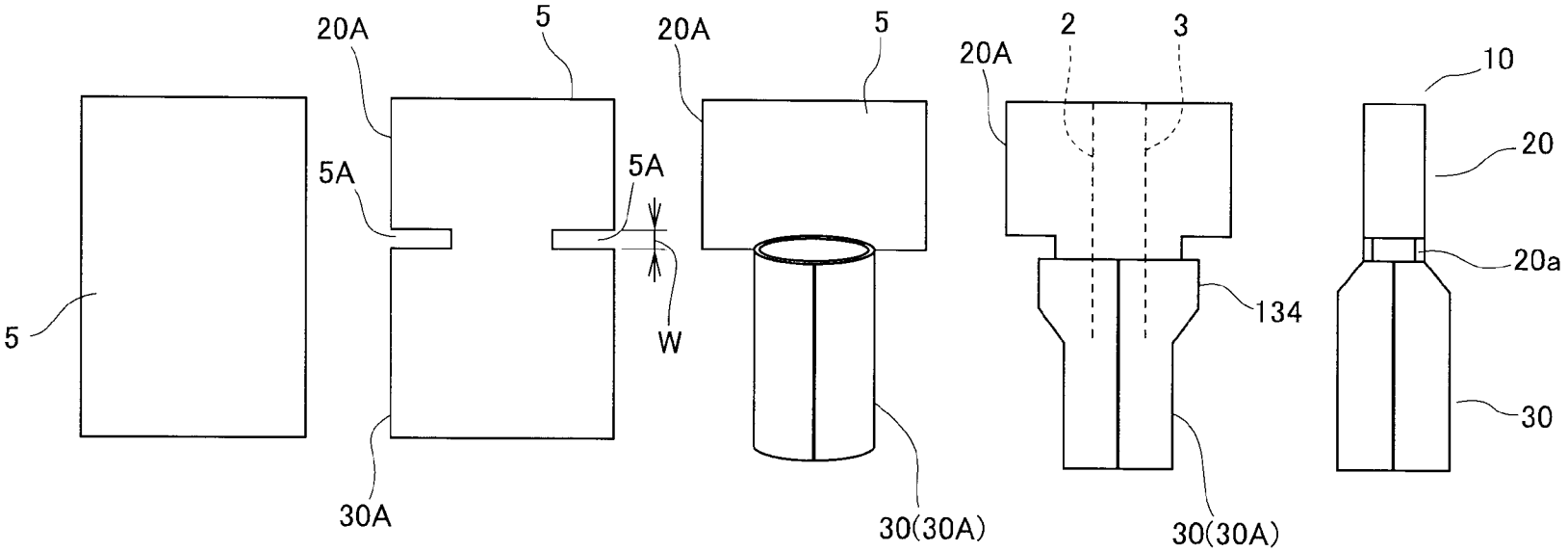
FIGS. 3A to 3E are diagrams showing a manufacturing procedure of the crimp terminal.

FIG. 3A shows one copper alloy strip 5 of brass or the like whose surface is tinned (subjected to Sn plating). The female type crimp terminal 10 is manufactured by punching the copper alloy strip 5 into a predetermined shape and then pressing the punched copper alloy strip 5.

As shown in FIG. 3B, the copper alloy strip 5 is punched out by a press under the state that the female type crimp terminal 10 is developed.

In this press step, slits 5A are formed between a planed portion 20A of the box portion 20 and a planed portion 30A of the crimp portion 30. The width W of the slits 5A is set to the requisite minimum dimension (for example, 0.6 mm) for punching of the copper alloy strip 5. Specifically, the width W of the slit 5A is desired to be 0.5 to 2 times as large as the plate thickness of the copper alloy strip 5. When the width W is excessively large, a site having the plate thickness of one sheet is formed to be large, so that the strength is lowered.

Next, as shown in FIG. 3C, the planed portion 30A of the crimp portion 30 is bent annularly in section, both the end faces thereof are made to abut against each other and welded, for example, by fiber laser, thereby forming the crimp portion 30 which is annular in section when viewed from the back side.

Figure 4:
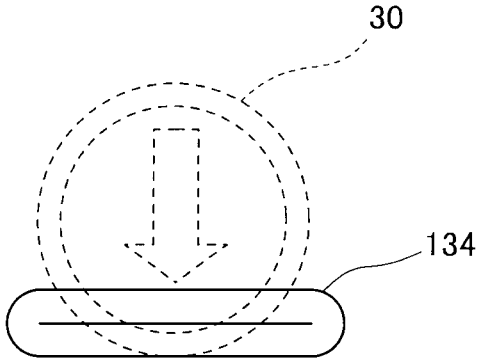
FIG. 4 is a diagram showing a manufacturing procedure of a sealing portion of the crimp terminal.

Next, as shown in FIG. 3D, the tip of the crimp portion 30 having the annular section is crushed to form the sealing portion 34. First, the tip side of the crimp portion 30 which projects ahead of the tip of the conductor tip portion 201*a* (FIG. 2A) is deformed to be flat and wide in the width direction Y in section as shown in FIG. 4, thereby forming a flat spread-out sealing portion 134 which is deformed to be flat in section when viewed from the front side in the longitudinal direction X. Specifically, at the front side of the tip of the conductor tip portion 201*a*, the crimp portion 30 is deformed so that the inner surfaces of the confronting crimp bottom surface 31 and barrel piece 32 are brought into close contact with each other, thereby forming the flat sealing portion 134 at the tip side of the crimp portion 30. After the flat sealing portion 134 is formed, laser welding is executed in the width direction to enhance the cut-off performance. Preferably, fiber laser which brings stability and high reliability may be used.

Figure 5:
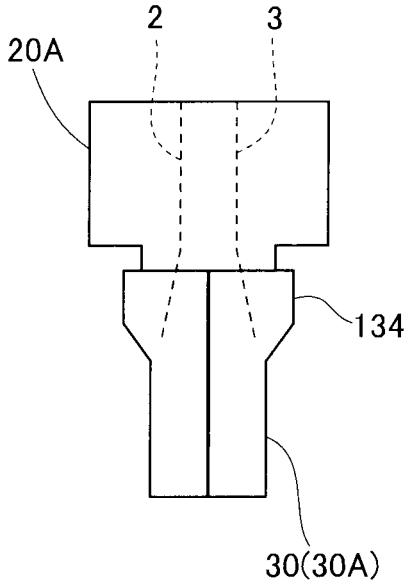
FIG. 5 is a diagram showing another embodiment.

In this embodiment, after the flat sealing portion 134 is subjected to the laser welding, pressing is executing along bend lines 2, 3 by using a molding member (not shown) such as a crimper jig or the like, and the flat sealing portion 134 is folded in a concave shape, thereby simultaneously completing the box portion 20 as shown in FIG. 3E. At this time, when the lines of the bend lines 2, 3 are continuous between the box portion 20 and the crimp portion 30, the lines may expand at the crimp portion 30 side as shown in FIG. 5.

Some patterns may be considered as a method of manufacturing the crimp terminal 10 in which the box portion 20 and the crimp portion 30 are connected to each other through the transition portion 20*a*.

(1) A procedure of completing the crimp portion 30 after the box portion 20 is first completed.

(2) A procedure of completing the box portion 20 after the crimp portion 30 is first completed.

In both the procedures, when the flat sealing portion 134 is folded in a concave shape, the step of folding the flat sealing portion 134 in a concave shape assists deformation of the box portion 20 and the crimp portion 30, so that the box portion 20 and the crimp portion 30 is liable to be deformed.

The method of manufacturing the terminal is not limited to the above embodiment, and it is needless to say that the box portion 20, the transition portion 20*a*, the sealing portion 134 and the crimp portion 30 are molded at the same time in the press machine.

In this embodiment, the flat sealing portion 134 is folded, and at the same time the box portion 20 is completed as shown in FIG. 3E. Therefore, unlike the procedures (1) and (2), the bending work of the flat sealing portion 134 does not influence the box portion 20 and the crimp portion 30.

Figure 2B:
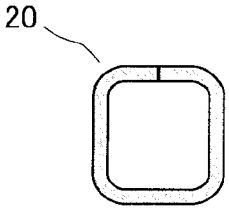
Figure 2C:
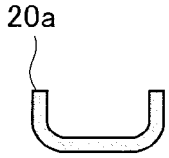
Figure 2D:
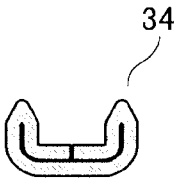

As shown in FIGS. 2B, 2C and 2D, the bending and erecting shape is desired to be uniform over the site from the box portion 20 to the flat sealing portion 134.

Specifically, the bottom surface the bottom surface is formed to be substantially concave continuously and uniformly from the box portion 20 to the flat sealing portion 134 as shown in FIGS. 2B to 2D.

The bottom surface may not be continuous and uniform. For example, it is enough that a part of a superimposed portion of the plate material is formed in a concave shape.

In this embodiment, the transition portion 20*a* is formed to be extremely short (for example, 0.6 mm), and the sealing portion 34 between the box portion 20 and the crimp portion 30 is shaped so that the plate material is superimposed and bent. By doubling and bending the plate material, the section modulus of this portion can be enhanced as compared with that of the other portions, and the strength of the female type crimp terminal 10 can be secured. As a result, moisture can be prevented from invading from the tip side of the crimp portion 30, and the sealing portion 34 can be formed so that the strength thereof can endure bending in the middle, etc. Accordingly, the excellent cut-off performance can be maintained over a long term under the state that the female type crimp terminal 10 is crimped to the covered electrical wire 200.

As shown in FIG. 6, when the width and height of the sealing portion 34 are represented by W and H, the height H is set within 65% of the width W. The height H is preferably set within 55%. The lower limit value of the height H is set to be equal to the thickness of two sheets of the plate material or more.

Since the height H is set to the thickness of the two sheets of the plate material or more, sufficient neck strength can be obtained, and a terminal whose strength can endure bending in the middle, etc. can be formed.

Table 1 shows test results.

Figure 6A:
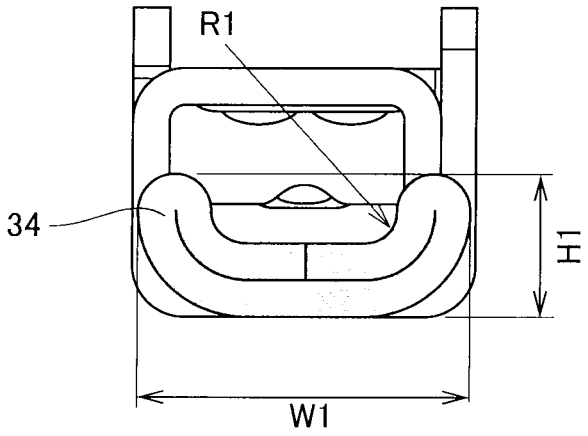
FIGS. 6 A to 6B are cross-sectional views showing a concave sealing portion according the other embodiment.
Figure 6B:
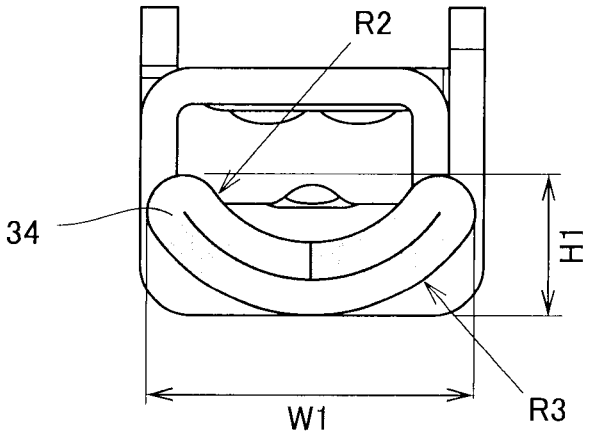
Figure 7:
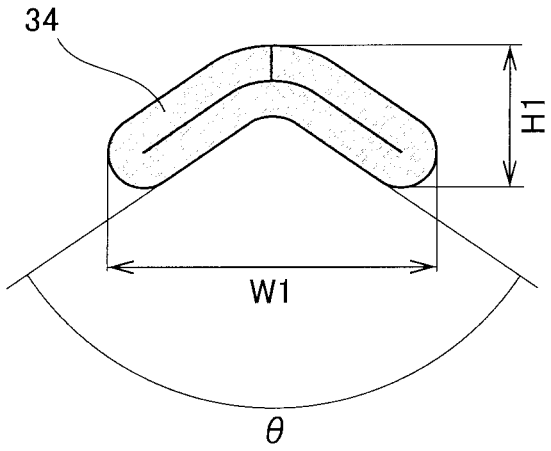
FIG. 7 is a cross-sectional view showing a concave sealing portion according to the other embodiment.

Test terminals contain a terminal in which the sealing portion 34 is bent to be substantially U-shaped as shown in FIG. 6A, a terminal in which the sealing portion 34 is bent to be substantially C-shaped as shown in FIG. 6B, and a terminal in which the sealing portion 34 is bent to be inversely V-shaped as shown in FIG. 7. W1 represents the width of the sealing portion 34, H1 represents the height of the sealing portion 34, R1, R2, R3 represent the bend radius, and θ represents the opening angle.

The sizes of the terminals are set to 0.64(025) size, 1.5 (060) size, and 2.3(090) size.

In FIGS. 6A, B, for the 0.64 (025) size terminal, W1=1.4 mm, H1=0.7 mm, R1=0.25 mm, R2=0.4 mm and R3=0.8 mm. For the 1.5(060) size terminal, W1=2.3 mm, H1=1.0 mm, R1=0.25 mm, R2=0.8 ram and R3=1.3 mm. For the 2.3(090) size terminal, W1=3.0 mm, H1=1.25 mm, R1=0.25 mm, R2=0.8 mm and R3=1.3 mm.

In FIG. 7, for the 2.3(090) size terminal, W1=3.0 mm, H1=0.75 mm and θ=150°.

For all the size terminals, it is desired that the length in the X direction of the sealing portion 34 shown in FIG. 2A is in the range from 0.6 to 1.3 mm. When this length is excessively short, there is a risk that return occurs after pressing, a gap (s) occurs between the superimposed plates at the sealing portion 34, and welding failure occurs. Accordingly, there is a risk that the cut-off performance cannot be maintained. When this length is excessively long, the terminal length increases. The most preferable length in the X direction of the sealing portion 34 is equal to approximately 1 mm.

In Table 1, O represents "good", Δ represents "possible" and X represents "impossible".

According to the test results, when the rate of the height H to the width W exceeds 65%, cracks are liable to occur in a terminal press work (in a bending work of the flat sealing portion 134) using progressive dies, and thus there occurs a risk that the press performance degrades and the cut-off performance is deteriorated. Furthermore, when the rate of the height H to the width W exceeds 65%, the bending degree increases, so that the apparent plate thickness is large and weldability is lowered. Therefore, it is difficult to weld the superimposed portion. Furthermore, a welding apparatus is complicated, so that the welding time is longer and the productivity is lowered. When the rate of the height H to the width W is within 55%, all the test results are "good".

TABLE 1

| RATE OF HEIGHT TO WIDTH | PRESS PERFORMANCE | WELDABILITY |
|---|---|---|
| No bending | ○ | ○ |
| 10% | ○ | ○ |
| 20% | ○ | ○ |
| 30% | ○ | ○ |
| 40% | ○ | ○ |
| 50% | ○ | ○ |
| 55% | ○ | ○ |
| 60% | Δ | ○ |
| 65% | Δ | ○ |
| 70% | X | X |

In this embodiment, as shown in FIGS. 2B to 2D, the bottom surface is configured to be substantially concave continuously and uniformly from the box portion 20 to the flat sealing portion 134. However, the bottom surface is not limited to this shape, and it may be formed in U-shape or V-shape, for example.

When the bottom surface is designed to be substantially concave continuously and uniformly from the box portion 20 to the flat sealing portion 134 as described above, no inflection point occurs in cross-sectional shape, and thus concentration of stress under application of external force can be prevented. Accordingly, deformation and fracture are suppressed over the site from the box portion 20 to the flat sealing portion 134. The cross-sectional shape is desired to be identical or similar at the respective portions.

In the crimp connection structure 1 having the above construction, the tip side of the crimp portion 30 is completely sealed by the concave sealing portion 34 so that the aluminum core wire 201 of the covered electrical wire 200 is not exposed to the outside. Therefore, moisture can be prevented from invading from the tip side of the crimp portion 30 into the crimp portion 30 after crimping. Accordingly, there can be prevented occurrence of electrical corrosion which is caused by adherence of moisture to the contact portion between the female type crimp terminal formed of copper or copper alloy as noble metal such as copper, copper alloy or the like and the aluminum core wire 201 formed of aluminum or aluminum alloy as base metal.

Accordingly, it can be prevented that the surface of the aluminum core wire 201 corrodes and the conductivities of the female type crimp terminal 10 and the aluminum core wire 201 decrease, and the cut-off (water-stopping) state can be kept over a long term, so that high reliability can be obtained.

That is, by executing crimping under the above desired crimp shape, the electrical corrosion can be prevented while reducing the weight of the covered electrical wire as compared with a covered electrical wire having a conductor formed of copper-based material. As a result, the crimp connection structure 1 having the connection state for which the stable conductivity can be secured can be constructed irrespective of the kinds of metals constituting the crimp terminal 10 and the covered electrical wire 200.

In the foregoing description, the crimp portion of the crimp terminal is crimp-connected to the electrical wire conductor formed of base metal such as aluminum, aluminum alloy or the like. However, in place of the base metal, the crimp portion may be crimp-connected to an electrical wire conductor formed of noble metal such as copper, copper alloy or the like, for example, and substantially the same action and effect as the foregoing embodiment can be obtained.

Furthermore, in place of the substantially U-shaped cross-section or substantially V-shaped cross-section, the cross-sectional shape of the concave sealing portion 34 may be set to a substantially elliptical cross-section, a substantially semicircular cross-section, a substantially W-shaped cross-section, a substantially angled U-shaped cross-section or the like, or a vertically inversed cross-sectional shape thereof or the like.

Furthermore, the female type crimp terminal 10 may be constructed by only the crimp portion 30 having the concave sealing portion 34 with no box portion 20.

In the foregoing description, the flat sealing portion 134 is subjected to laser welding in the width direction, and then deformed in U-shape to form the concave sealing portion 34. However, the laser welding may be performed after the flat sealing portion 134 is deformed in U-shape to form the concave sealing portion 34. The tip side of the crimp portion 30 is deformed to have a cross-sectional flat shape which is wide in the width direction Y, thereby forming the flat sealing portion 134 which is deformed to be flat in cross-section when viewed from the front side in the longitudinal direction, and then the flat sealing portion 134 is deformed to be substantially U-shaped in cross-section, thereby forming the concave sealing portion 34. However, the inner surface of the crimp bottom surface 31 and the inner surface of the barrel piece 32 may be brought into close contact with each other, and deformed to be substantially U-shaped in section to form the concave sealing portion 34.

Figure 8A:
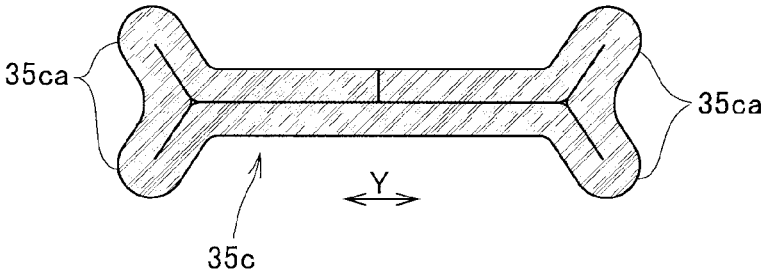
FIGS. 8A to 8E are cross-sectional views showing concave sealing portions according to the other embodiments.
Figure 8B:
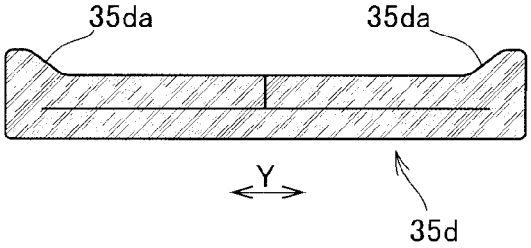

Specifically, the cross-sectional shape of the concave sealing portion 34 may be designed like a concave sealing portion 35*c* having projecting portions 35*ca* in which both the sides thereof in the width direction Y thereof are projected obliquely upwards and downwards to be substantially Y-shaped under a lying state as shown in FIG. 8A. Furthermore, the cross-sectional shape of the concave sealing portion 34 may be designed like a concave sealing portion 35*d* having projecting portions 35*da* in which both the sides in the width direction thereof are projected only upwards to be substantially L-shaped under a lying state as shown in FIG. 8B.

Figure 8C:
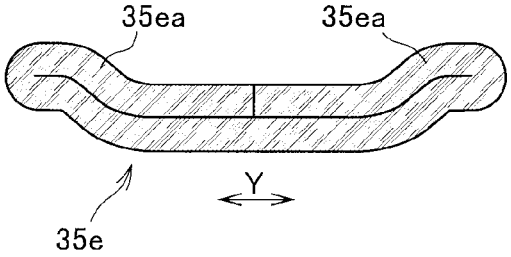
Figure 8D:
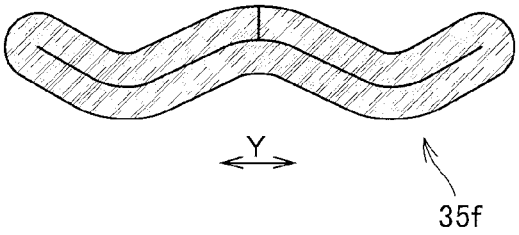
Figure 8E:
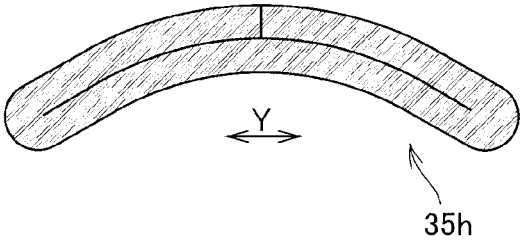

Furthermore, the sealing portion may be formed as a concave sealing portion 35*e* having bent portions 35*ea* in which neighboring portions of both the sides in the width direction Y thereof are decentered in parallel to the up-and-down direction as shown in FIG. 8C, and also may be formed as a substantially W-shaped concave sealing portion 35*f* as shown in FIG. 8D. Furthermore, as shown in FIG. 8E, the concave sealing portion 34 described above may be modified upside down, thereby forming an inverted U-shaped concave sealing portion 35*h* which is convex upwards. Likewise, the sealing portion 35 (35A to 35D) may be modified upside down. Even when the concave sealing portion is modified as an inversed concave sealing portion or vertically inversed or non-inversed, the sealing portions 35 (35A to 35D) described above have the same effect as achieved by the concave sealing portions 34 described above.

In this embodiment, the aluminum core wire 201 comprising a bundle of aluminum element wires is used as the covered electrical wire 200. However, the covered electrical wire 200 is not limited to this style, and it may be applied to a copper electrical wire.

A plurality of electrical wire connection structures each having the above female type crimp terminal 10 and the covered electrical wire 200 which are connected to each other may be bundled, and the respective crimp terminals 10 may be connected to a multi-core connector (not shown), thereby constructing a wire harness for a vehicle, for example.

Next, another embodiment of the present invention will be described with reference to the drawings. In the figures, the longitudinal direction of the crimp terminal and the covered electrical wire is defined as an x-axis direction, the thickness direction of the metal strip of the transition portion and the height direction of the crimp portion, etc. in the figures are defined as a y-axis direction, and the width direction of the transition portion is defined as a z-axis direction. The x-axis, the y-axis and the z-axis are perpendicular to each other.

Figure 9:
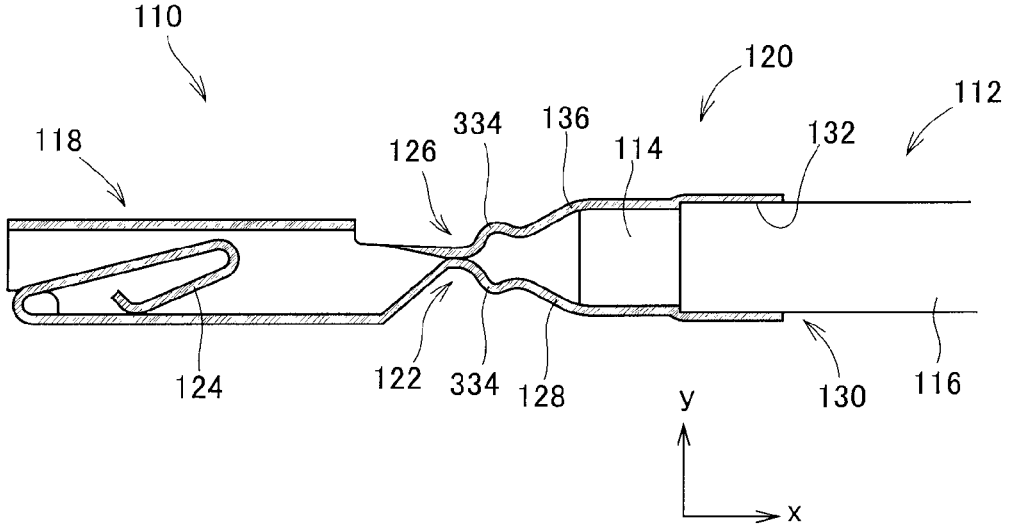
FIG. 9 is a cross-sectional diagram showing the crimp terminal according to the present invention.

As shown in FIG. 9, a covered electrical wire 112 to be connected to a crimp terminal 110 has a structure that a core wire 114 is covered with an insulating cover 116. In FIG. 9, the core wire 114 is illustrated by one wire. However, the actual wire core 114 comprises a bundle of plural aluminum element wires. The wire core 114 may comprise one aluminum element wire when the aluminum element wire is thick. The diameter of the core wire 114 is approximately 1 mm, for example. The aluminum element wire is formed of aluminum-based material such as aluminum, aluminum alloy or the like. The insulating cover 116 is formed of insulating resin, and halogen-free polyolefin or the like may be used as the insulating resin. The thickness of the insulating cover 116 is equal to approximately 0.3 mm, for example. At the tip portion of the covered electrical wire 112, the insulating cover 116 is removed, and only the core wire 114 exists.

Figure 10:
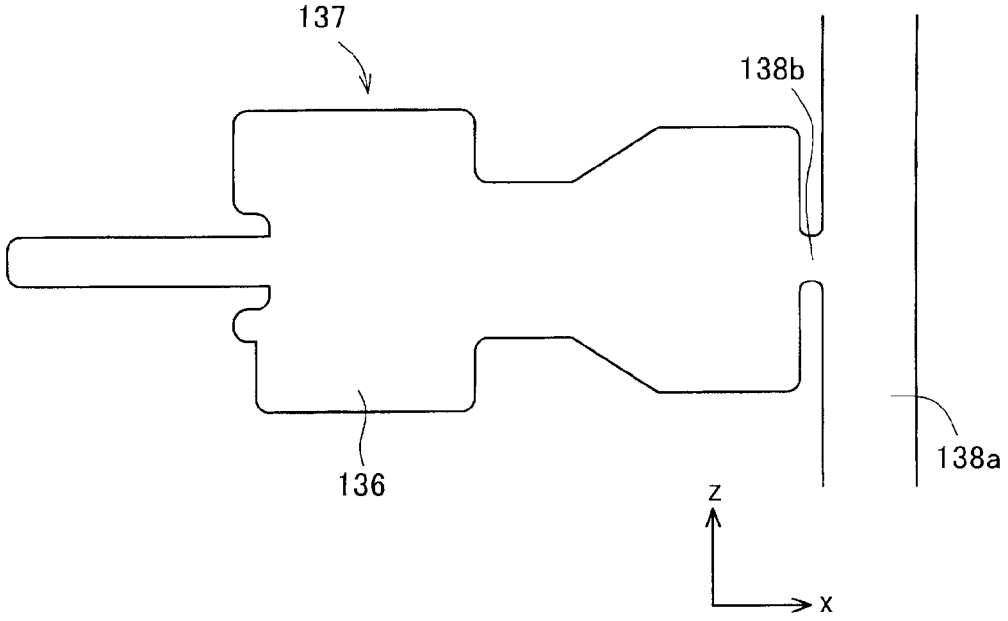
FIG. 10 is a diagram showing a cut metal strip.

The crimp terminal 110 of the present invention shown in FIG. 9 has a box portion 118, a crimp portion 120 and a transition portion (neck portion) 122 between the box portion 118 and the crimp portion 120. The crimp terminal 110 is formed by cutting a metal strip 136 in a predetermined shape and executing a bending work or the like as shown in FIG. 10. The metal strip 136 is formed of copper-based material such as copper, copper alloy or the like, for example, and specifically brass whose surface is subjected to tin-plating is used.

The outer shape of the box portion 118 is box-shaped, and a spring portion 124 is provided in the box portion 118. The box portion 118 is a female type terminal. A male type terminal of another electrical equipment is inserted into the box portion 118 to perform electrical connection therebetween. The male type terminal is pressed against the inner wall of the box portion 118 by the spring portion 124. The box portion 118 may be a male type terminal so as to be connectable to a female type terminal of another electrical equipment.

Figure 11A:
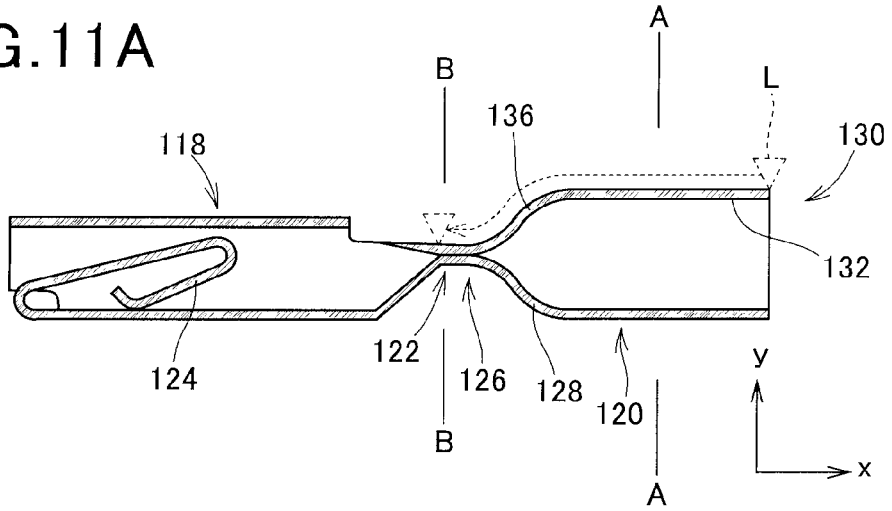
Figure 11B:
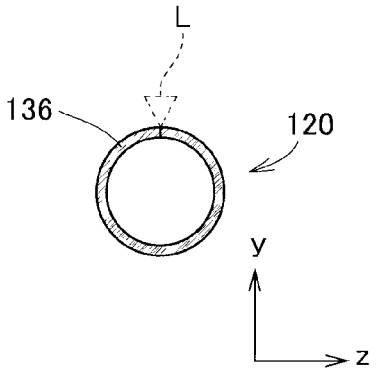

As shown in FIG. 9 and FIG. 11B, the crimp portion 120 is configured in a barrel-like shape, and one end portion 126 thereof is configured as a slope portion 128 while the other end portion 130 is configured as an opening portion 132.

The inner periphery of the cross-section of the crimp portion 120 is circular, and it is preferable that the inner periphery of the cross-section of the crimp portion 120 is designed to be fitted to the outer shape of the covered electrical wire 112.

Figure 11C:
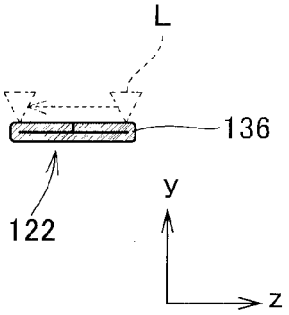

The transition portion 122 is configured to be planar. The crimp portion 120 to be connected to the transition portion 122 is cylindrical. Therefore, at the transition portion 122, the metal strip 136 is folded and superimposed as shown in FIG. 11C when the metal strip 136 is subjected to the bending work. At the transition portion 122, welding is performed in the z-axis direction, whereby the superimposed metal strip 136 is welded and fixed. Accordingly, the one end portion 126 of the crimp portion 120 is sealed by the transition portion 122.

The one end portion 126 of the crimp portion 120 is prevented from being exposed to the outside by the transition portion 122 adjacent to the slope portion 128. The tip portion of the covered electrical wire 112 is inserted from the other end portion 130 into the crimp portion 120. The covered electrical wire 112 has no insulating cover in the neighborhood of the slope portion 128 of the crimp portion 120, and has the insulating cover 116 in the neighborhood of the other end portion 130. The crimp portion 120 and the insulating cover 116 are brought into close contact with each other with no gap therebetween by crimping, whereby a cut-off (water-stopping) effect of preventing infiltration of water into the crimp portion 120 can be obtained. The plate thickness of the crimp portion 120 is equal to 0.25 mm, for example.

The transition portion 122 is a narrowed part between the box portion 118 and the crimp portion 120. The transition portion 122 is provided at an intermediate position between the upper and lower portions in the y-axis direction of the box portion 118 and the crimp portion 120. For example, when the transition portion 122 is provided at the lower portion of the crimp portion 120, the metal strip 136 must be designed so that the upper portion reaches the lower portion, and this is difficult when the diameter of the covered electrical wire 112 is large. By locating the transition portion 122 at the intermediate position in the y-axis direction of the crimp portion 120, the metal strip 136 is easily superimposed from the upper and lower sides when the metal strip 122 is subjected to the bending work to form the transition portion 122. Accordingly, even when the diameter of the covered electrical wire 112 increases, the transition portion 122 is easily formed. In FIG. 9, the transition portion 122 is located at the center in the y-axis direction of the crimp portion 120, but it may be provided at any other position than the positions corresponding to the upper and lower portions of the crimp portion 120.

A convex portion 334 is provided at the tip of the slope portion 128 of the crimp portion 120 so as to face the outside of the crimp portion 120. There is a case where a part of the convex portion 334 reaches the neighborhood of the welded portion of the transition portion 122. When the sectional shape of the convex portion 334 in the longitudinal direction (x-axis direction) of the covered electrical wire 112 is viewed, the convex portion 334 is triangular or arcuate. Even when the sectional shape is triangular, the corners thereof may be curved.

A portion at which the convex portion 334 is formed and the periphery of the portion are increased in second moment of area, and the strength in the y-axis direction of FIG. 9 increases. Accordingly, the strength of the crimp terminal 110 is enhanced more greatly as compared with the prior arts, and breaking and deformation of the crimp terminal 110 can be suppressed. The suppression of breaking and deformation of the crimp terminal 110 brings an effect of improving the yield of the crimp terminal 110 and the wire harness.

Next, a method of manufacturing the crimp terminal 110 described above will be described.

(1) A metal strip 136 is cut into a predetermined shape as shown in FIG. 10, and a box portion 118, a crimp portion 120 and a transition portion 122 are formed by a bending work. The box portion 118 is configured to have a box-shape, the crimp portion 120 is configured to have a pipeshape and the transition portion 122 is configured to have a planar shape and narrowed between the box portion 118 and the crimp portion 120.

In FIG. 10, a portion 137 which will serve as a crimp terminal 110 is connected to a carrier portion 138*a* through a bridge portion 138*b*. The carrier portion 138*a* continues in the z-axis direction of FIG. 10, plural bridge portions 138*b* are formed at an equal interval, and portions 137 which will serve as crimp terminals 110 are connected to the respective bridge portions 138*b*. Plural crimp terminals 110 are manufactured from one metal strip 136. The portions 137 which will serve as the crimp terminals 110 are cut out from the bridge portions 138*b* during the manufacturing process of the crimp terminals 110.

(2) As shown in FIGS. 11A and 11B, the crimp portion 120 and the transition portion 122 are welded so that the end portions of the metal strip 136 are connected to each other.

Furthermore, as shown in FIG. 11C, welding is performed so as to traverse the transition portion 122, and the welded portion of the superimposed metal strip 136 is welded. One end portion 126 of the crimp portion 120 is sealed by the transition portion 122.

Laser welding may be used for welding. For example, in the case of fiber laser L, it has an ideal Gauss distribution beam, and can condense light till the diffraction limit. The fiber laser L can provide light having a spot diameter of 30 μm or less which has not been implemented by YAG laser or carbon dioxide laser. Therefore, welding having high energy density can be easily performed.

The transition portion 122 is narrowed from the two directions as described above, and located at the center or in the neighborhood of the center in the height direction (y-axis direction) of the crimp terminal 110. Accordingly, the step between the crimp portion 120 and the transition portion 122 is smaller as compared with a crimp terminal which is narrowed from only one direction. When the step is larger, it is necessary to change the focal point of the laser. However, when the step is small, it is unnecessary to change the focal point. According to this invention, when laser welding is performed, the crimp portion 120 and the transition portion 122 which are different in height can be welded without changing the focal point of the laser.

Figure 12A:
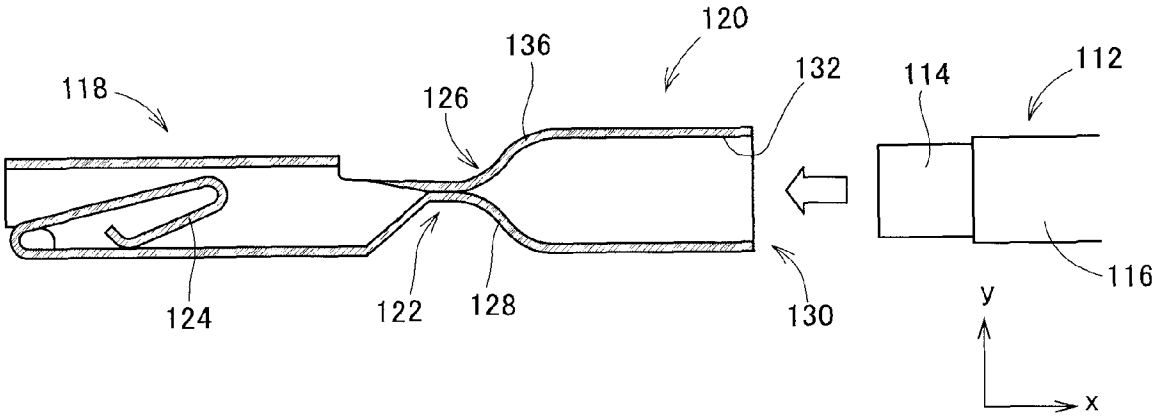
FIG. 12A is a diagram showing insertion of a covered electrical wire in a crimp portion.
Figure 12B:
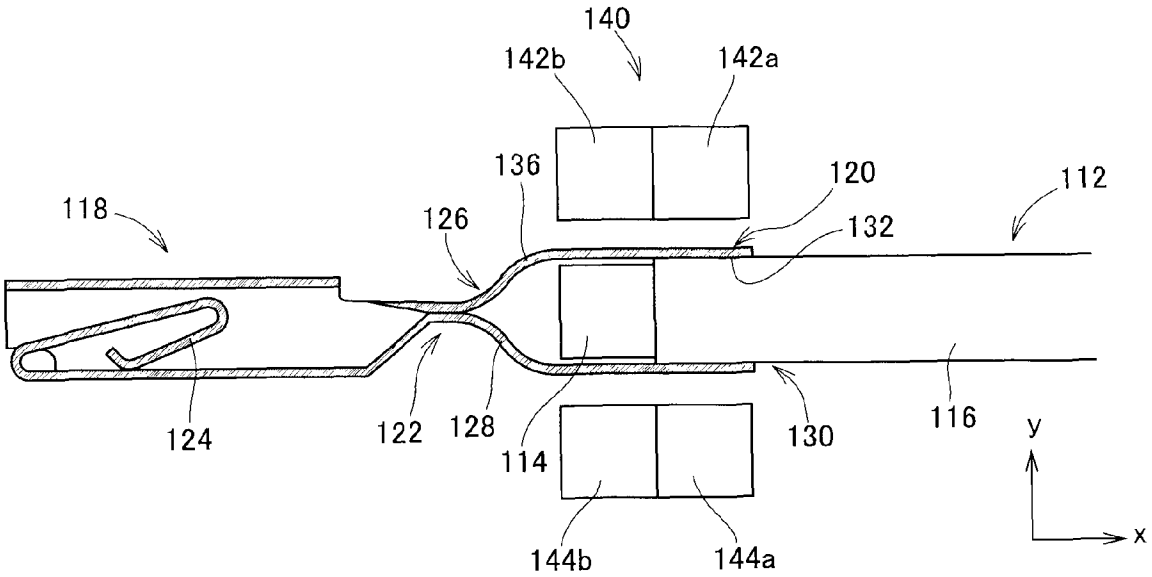
FIG. 12B is a diagram before crimping of dies.

(3) As shown in FIGS. 12A and 12B, the covered electrical wire 112 from which the insulating cover 116 at the tip is removed is inserted from the opening portion 132 of the other end portion 130 of the crimp portion 120, and crimped by a die 140. The covered electrical wire 112 is not disposed at the slope portion 128 of the crimp portion 120, but disposed at a cylindrically-shaped portion having a fixed size. In the crimping step, the box portion 118 is gripped to fix the crimp portion 120 at a predetermined position.

Figure 13:
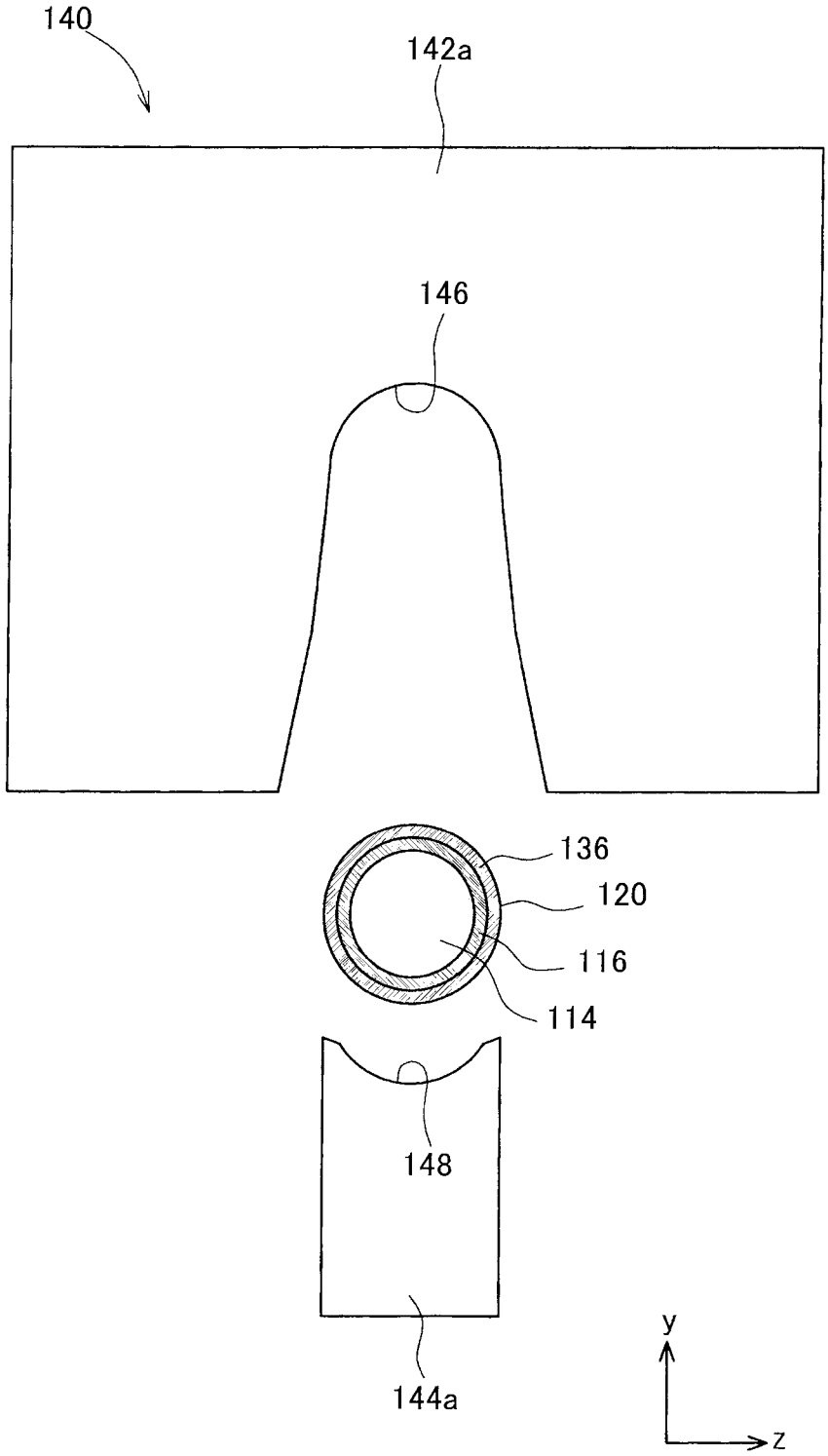
FIG. 13 is a diagram showing the dies.

As shown in FIG. 12B and FIG. 13, the die 140 comprises first dies 142*a*, 142*b* and second dies 144*a*, 144*b*. Concave portions 146, 148 are formed on the dies 142*a*, 142*b*, 144*a*, 144*b*. When the crimp portion 120 having the covered electrical wire 112 inserted therein is put and crimped in the concave portions 146, 148, the crimp portion 120 is shaped so that the outer shape thereof is conformed with the shapes of the concave portions 146, 148. For example, the outer shape of the crimp portion 120 is set to be cylindrical or substantially cylindrical.

The first dies 142*a*, 142*b* and the second dies 144*a*, 144*b* are divided between a position at which the insulating cover 116 of the covered electrical wire 112 exists and a position at which the insulating cover 116 of the covered electrical wire 112 does not exist, and the shapes of the concave portions 146, 148 are made different between these positions. At the position where the insulating cover 116 does not exist, the space formed by the concave portions 146, 148 is set to be smaller than the space at the position where the insulating cover 116 exists.

The die 140 is disposed over a site from the other end portion 130 of the crimp portion 120 to the position corresponding to the tip of the covered electrical wire 112 or a part of the slope portion 128. The core wire 114 of the covered electrical wire 112 is electrically connected to the crimp portion 120 by crimping. In the neighborhood of the other end portion 130 of the crimp portion 120, the crimp portion 120 and the insulating cover 116 of the covered electrical wire 112 are crimped to each other with no gap therebetween. Moisture is prevented from infiltrating into the crimp portion 120, so that electrical corrosion can be prevented.

When crimping, the box portion 118 is gripped to fix the crimp terminal 110. Furthermore, the superimposed metal strip 136 is welded and fixed at the transition portion 122 by welding. Furthermore, a part of the crimp portion 120 is pushed out to the transition portion 122 or a part of the slope portion 128 of the crimp portion 120 is crushed and transferred to the transition portion 122 by crimping. Accordingly, the convex portion 334 can be formed at a site from the tip of the slope portion 128 of the crimp portion 120 or the neighborhood of the welded portion of the transition portion 122 to the crimp portion 120 by crimping.

The convex portion 334 is a part or the whole of the slope portion 128 which is left when the slope portion 128 is crushed. In other words, it is a part or the whole of the slope portion 128 which remains after the slope portion 128 is crimped.

By forming this convex portion 334, force is hardly applied to the welded portion of the superimposed portion under crimping, and thus neck breaking under crimping can be prevented. Furthermore, the tip of the core wire 114 enters the space of the convex portion 334 under crimping and is crimped, and thus the tip of the electrical wire also is shaped like a so-called bell-mouth, so that the electrical wire is hard to come off.

(4) After crimping, the dies 142*a*, 142*b*,144*a*, 144*b* are mutually separated from one another, and the crimp terminal 110 is taken out from the dies 142*a*, 142*b*, 144*a*, 144*b*. The crimp terminal 110 is secured to the covered electrical wire 112. A wire harness can be constructed by forming a connector in which a predetermined number of covered electrical wires 112 are bundled and the crimp terminals 110 are arranged longitudinally and laterally.

As described above, according to the present invention, the convex portion 334 is provided, so that the position at which the convex portion 334 is provided and the periphery thereof are enhanced in strength. Accordingly, as compared with prior arts, deformation and breaking of the crimp terminal 110 can be prevented, and a desired connector for a wire harness can be easily formed. No complicated step is provided to form the convex portion 334, and thus the manufacturing process is not complicated.

The crimp portion 120 and the covered electrical wire 112 are crimped to each other, and the other end portion 130 of the crimp portion 120 has no gap between the insulating cover 116 of the covered electrical wire 112 and the crimp portion 120. One end portion 126 of the crimp portion 120 is sealed by the transition portion 122. Moisture is prevented from infiltrating into the cylindrical crimp portion 120, so that no electrical corrosion occurs.

Figure 14:
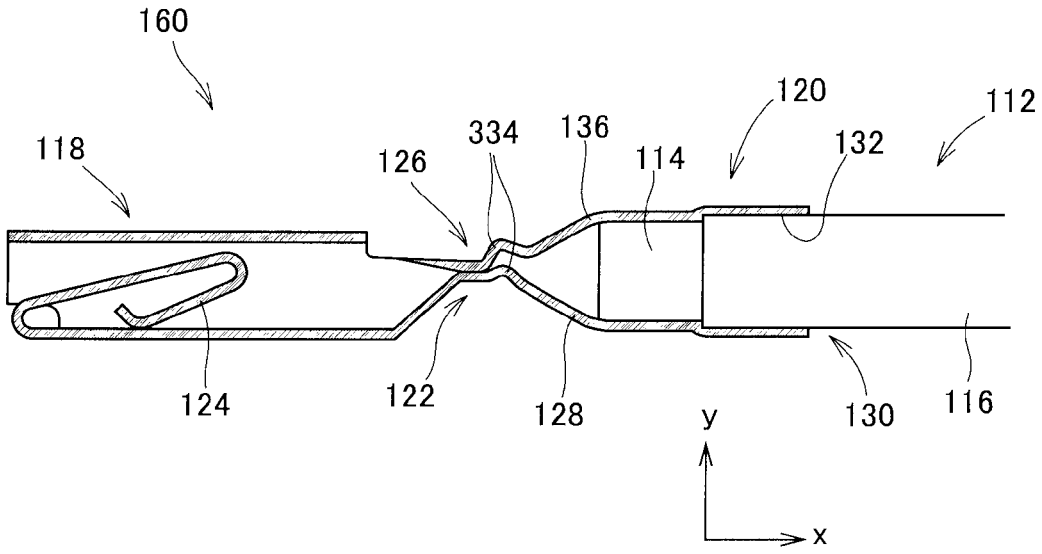
FIG. 14 is a cross-sectional view showing the crimp terminal in which the convex portions are oriented to one direction.

The present invention has been described on the basis of the embodiments, but the present invention is not limited to the above embodiments. The convex portions 334 shown in FIG. 9 are provided symmetrically in the up-and-down direction (y-axis direction). However, the convex portions 334 may be formed so as to face one direction as in the case of a crimp terminal 160 of FIG. 14. One of the convex portions 334 is convex to the inside of the crimp portion 120.

The convex portions 334 may be formed at any position from the welded position of the transition portion 122 to the slope portion 128 of the crimp portion 120. At the transition portion 122, the convex portions 334 may be formed at only positions where no welding is performed. The convex portions 334 may be formed over a site from the transition portion 122 to the crimp portion 120.

Figure 15:
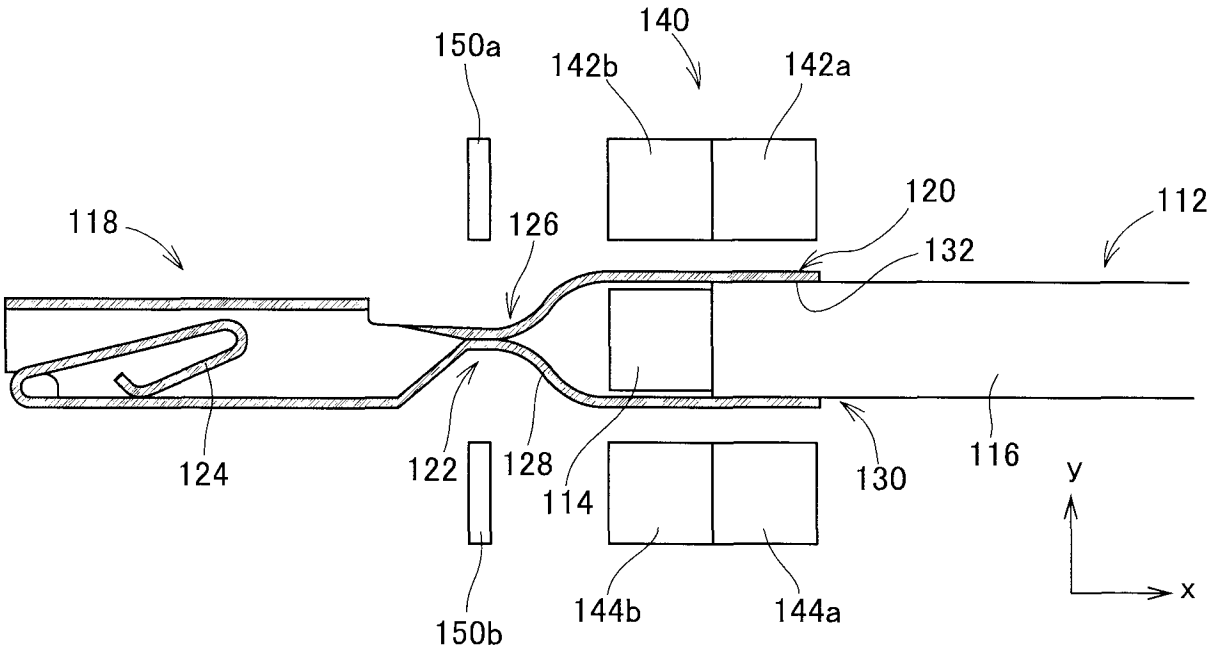
FIG. 15 is a diagram showing pinching of the transition portion by dies.

As shown in FIG. 15, dies 150*a*, 150*b* which pinch the transition portion 122 may be used. The position of the transition portion 122 under crimping is fixed by pinching the transition portion 122. As described above, the metal strip 136 of the crimp portion 120 is moved under crimping. Therefore, the convex portion 334 is made to be easily formed by fixing the position of the transition portion 122. The convex portions 334 are formed at positions adjacent to the portions pinched by the dies 150*a*, 150*b*. When the transition portion 122 is strongly crimped, the thickness is reduced, and thus the strength of the transition portion 122 is lowered. Therefore, the pinching is performed to the extent that the position of the transition portion 122 can be fixed.

In the above embodiments, the convex portions 334 are formed. However, no convex portion 334 may be formed as in the case of a crimp terminal 180 of FIG. 16. The transition portion 122 is disposed at an intermediate position between the upper and lower portions in the height direction (y-axis direction) of the crimp portion 120 and the box portion 118, and the crimp terminal 180 is narrowed at the transition portion 122, whereby force applied to the slope portion 128 concentrates on one end portion 126 of the crimp portion 120. Furthermore, the transition portion 122 is disposed at the center of the crimp terminal 180 or in the neighborhood of the center, whereby the crimp terminal is adaptable to external force from various directions. Accordingly, the strength is more greatly enhanced as compared with the case where the transition portion 122 is provided at the upper or lower portion in the y-axis direction.

Figure 16:
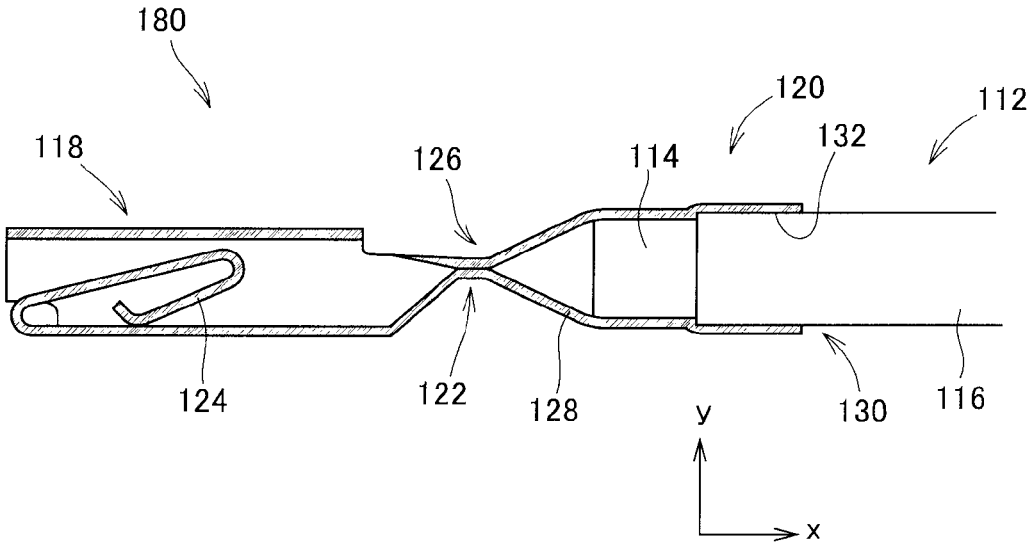
FIG. 16 is a cross-sectional view showing the crimp terminal in which the transition portion is narrowed with respect to the box portion and the crimp portion.

The manufacturing process of the crimp terminal 180 of FIG. 16 is the same as the above embodiments, but it may be performed so that no convex portion 334 occurs when crimping is performed by the die 140. For example, a convex portion (burr) directing to the outside of the crimp portion 120 is generated so that a part of the metal strip 136 of the crimp portion 120 is prevented from moving to the transition portion 122.

Various improvements, corrections and modifications may be made on the basis of the knowledge of persons skilled in the art without departing from the subject matter of the present invention.

What is claimed is:

1. A crimp terminal comprising:

a fitting portion at a tip of the crimp terminal; and an electrical wire connection portion at a rear end of the crimp terminal, wherein the electrical wire connection portion is configured in a tubular shape, a tip of the tube is crushed to be superimposed and closed to form, a superimposed and closed portion, and at a position between the fitting portion and the electrical wire connection portion, the superimposed and closed portion of superimposed two or more sheets of a plate material are bent to form the crimp terminal, and the superimposed and closed portion is longitudinally welded at a seam between the superimposed two or more sheets.

2. The crimp terminal according to claim 1, wherein the crimp terminal is formed by bending the superimposed and closed portion.

3. The crimp terminal according to claim 1, wherein a bending and erecting shape has a uniform cross section from the fitting portion to the superimposed and closed portion.

4. The crimp terminal according to claim 1, wherein the portion between the fitting portion and the electrical wire connection portion is configured to be bent in any shape selected from the group consisting of U-shape, V-shape and a concave shape.

5. The crimp terminal according to claim 1, wherein a ratio of height H to width W of a sealing portion at which the two or more sheets of the plate material are superimposed and bent is 65% or less.

6. A method of manufacturing a crimp terminal having a fitting portion at a tip of the crimp terminal and an electrical wire connection portion at a rear end of the crimp terminal, the electrical wire connection portion being configured in a tubular shape, comprising:

forming a superimposed and closed portion by crushing a tip of the tube so that the tip of the tube is superimposed and closed; and forming a portion by integrally bending a portion between the fitting portion and the electrical wire connection portion and the superimposed and closed portion of superimposed two or more sheets of a plate material, and welding a seam between the superimposed two or more sheets longitudinally along the superimposed and closed portion.

7. The method of manufacturing the crimp terminal according to claim 6, wherein a portion from the fitting portion to the superimposed and closed portion is bent while a bending and erecting shape is uniform.

8. The method of manufacturing the crimp terminal according to claim 6, wherein the portion between the fitting portion and the electrical wire connection portion is formed to be bent in any shape selected from the group consisting of U-shape, V-shape and a concave shape.

9. An electrical wire connection structure comprising:

a crimp terminal that comprises a fitting portion at a tip of the crimp terminal and an electrical wire connection portion at a rear end of the crimp terminal, the electrical wire connection portion being configured in a tubular shape, and is formed by crushing a tip of the tube so that the tip of the tube is superimposed and closed to form a superimposed and closed portion, and bending at a position between the fitting portion and the electrical wire connection portion, the superimposed and closed portion of superimposed two or more sheets of a plate material, the superimposed and closed portion being longitudinally welded at a seam between the superimposed two or more sheets; and an electrical wire that is crimp-connected to the electrical wire connection portion of the crimp terminal.

10. A wire harness comprising a bundle of a plurality of the electrical connection structures according to claim 9, and a multi-core connector to which the crimp terminals of the electrical connection structures are connected.

* * * * *